US005147501A

United States Patent [19]

Cade et al.

[11] Patent Number: 5,147,501

[45] Date of Patent: * Sep. 15, 1992

[54] ELECTRONIC DEVICES

[75] Inventors: Neil A. Cade, Rickmansworth; Rosemary A. Lee, Northwood; Chandrakant Patel, Edgware; Helen A. Williams, High Wycombe, all of United Kingdom

[73] Assignee: The General Electric Company, p.l.c., England

[ * ] Notice: The portion of the term of this patent subsequent to Nov. 27, 2007 has been disclaimed.

[21] Appl. No.: 464,431

[22] Filed: Jan. 12, 1990

[30] Foreign Application Priority Data

Jan. 18, 1989 [GB] United Kingdom ..... 8901085

[51] Int. Cl.[5] ..... H01J 1/30

[52] U.S. Cl. ..... 156/656; 156/657; 156/659.1; 156/661.1; 156/647; 313/309; 445/35; 445/46; 445/58

[58] Field of Search ..... 156/656, 657, 659.1, 156/661.1, 647; 313/309; 445/35, 46, 58

[56] References Cited

U.S. PATENT DOCUMENTS

| | | | |
|---|---|---|---|
| 3,789,471 | 2/1974 | Spindt et al. | 29/25.17 |
| 4,522,682 | 6/1985 | Soclof | 156/647 |
| 4,973,378 | 11/1990 | Lee et al. | 156/657 X |
| 4,983,878 | 1/1991 | Lee et al. | 156/648 X |

FOREIGN PATENT DOCUMENTS

| | | |
|---|---|---|
| WO8806345 | 8/1988 | PCT Int'l Appl. . |
| 1226627 | 3/1971 | United Kingdom . |
| 1374930 | 11/1974 | United Kingdom . |

*Primary Examiner*—Thi Dang

*Attorney, Agent, or Firm*—Kirschstein, Ottinger, Israel & Schiffmiller

[57] ABSTRACT

In the production of micron-size pyramid emitters for field emission devices, a first layer of electrically-conductive material, such as single crystal silicon or metal, is etched to form column-like structures each of which tapers from each end of the column towards an intermediate portion along its length. A second conductive layer is formed in contact with the free ends of the columns, and etching of the columns is then resumed until the intermediate portion of each column is etched through, leaving a pair of pyramid emitters pointing towards one another and supported by the respective conductive layer.

10 Claims, 5 Drawing Sheets

ELECTRONIC DEVICES

BACKGROUND OF THE INVENTION

1. Field of the Invention

This invention relates to a method of making electronic devices and to such devices per se. The devices may be, more particularly, field emission devices.

2. Description of Related Art

During recent years there has been considerable interest in the construction of field emission devices having cathode dimensions and anode/cathode spacings of the order of only a few microns. In the manufacture of some such devices, arrays of pyramid-shaped cathodes have been formed by etching away unwanted regions of a crystal or metal layer, leaving behind the required pyramid shapes. A planar metal anode layer has then been formed, spaced from and insulated from the cathodes. This anode layer may be continuous or may be divided into smaller areas to form individual anodes or groups of anodes.

SUMMARY OF THE INVENTION

It is an object of the present invention to provide a new method of forming a field emission device. It is a further object of the invention to provide a new field emission device structure.

According to one aspect of the invention there is provided a method of forming an electron emission device, the method comprising providing a first layer of electrically-conductive material; forming from said first layer a column-like structure having a first end integral with said first layer and a second end, said structure having a first portion tapering from said first end towards an intermediate region of the structure and a second portion tapering from said second end towards said intermediate region; said second end of said structure being attached to a second electrically-conductive layer spaced from said first layer; and removing part of the structure at said intermediate region to separate said first and second portions, whereby two tapered bodies are provided with their sharp ends substantially aligned and closely spaced, to form respective electrodes of the device.

According to another aspect of the invention there is provided a field emission device comprising two sharp-ended tapered electrically-conductive bodies of length in a range up to 1 mm, the sharp ends of the two bodies being spaced apart substantially in alignment with each other and directed towards each other.

BRIEF DESCRIPTION OF THE DRAWINGS

Embodiments of the invention will now be described, by way of example, with reference to the accompanying drawings, in which FIGS. 1(*a*) to (*j*) illustrate, schematically, stages in a method in accordance with the invention for forming a plurality of field-emission devices.

DETAILED DESCRIPTION OF THE PREFERRED EMBODIMENTS

Figure 1A:
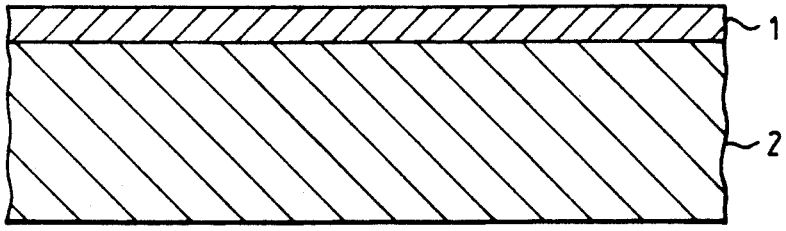
Figure 1B:
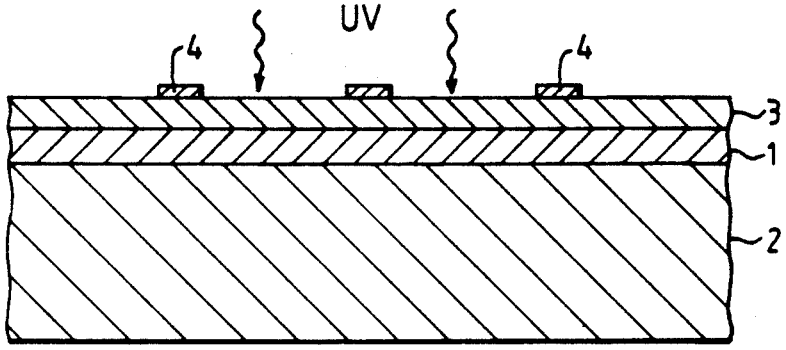
Figure 1C:
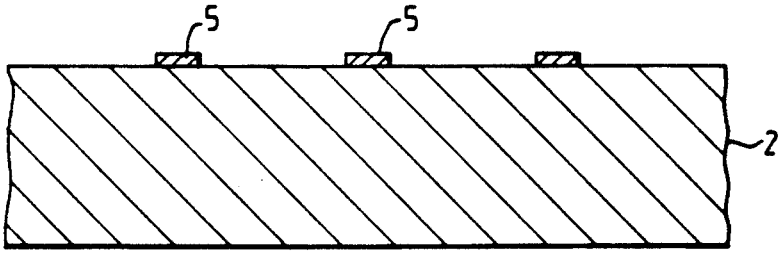
Figure 1D:
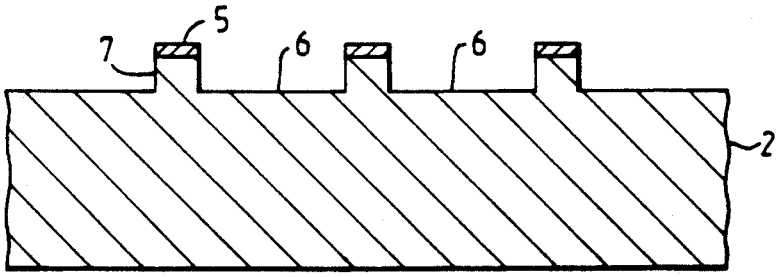
Figure 1E:
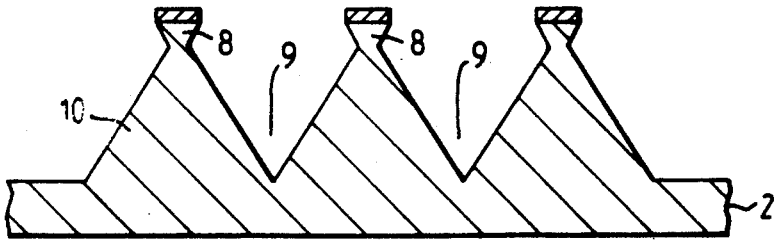
Figure 1F:
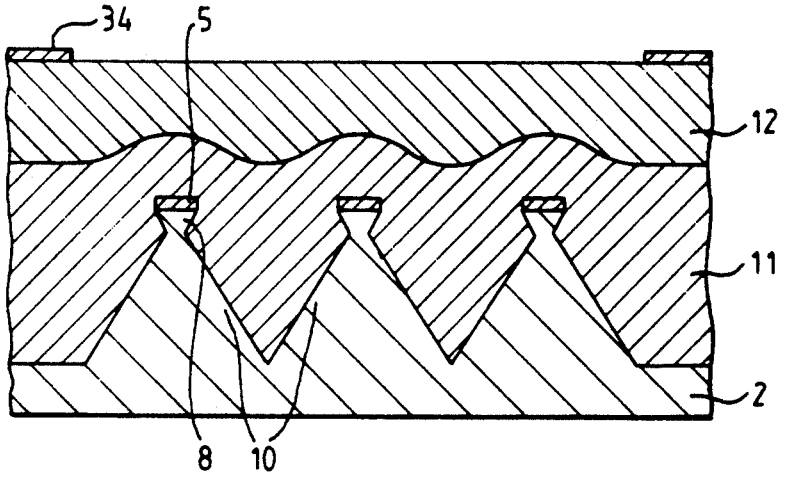
Figure 1G:
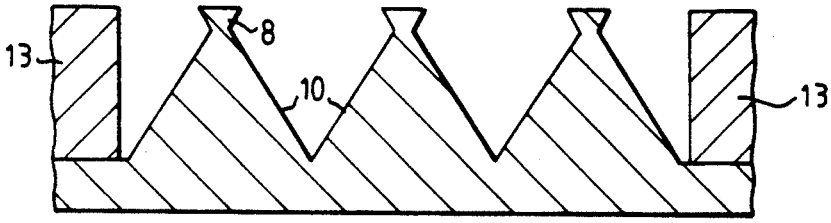
Figure 1H:
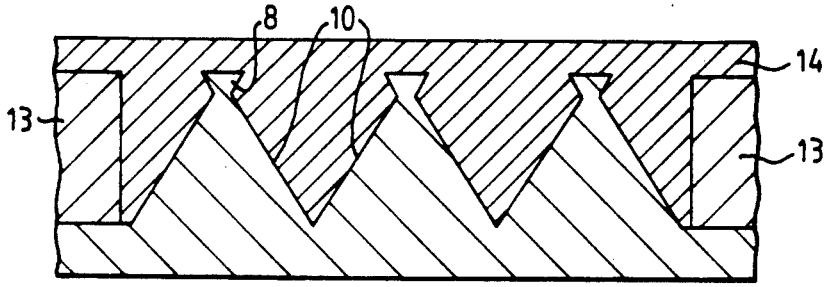
Figure 1I:
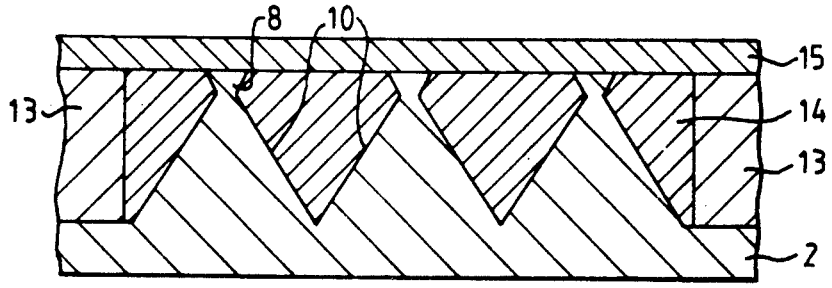
Figure 1J:
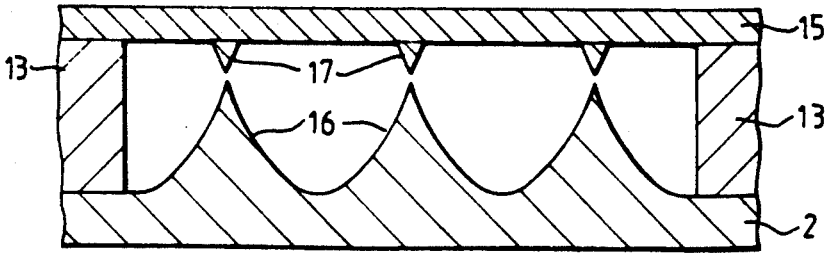

Referring to FIG. 1(*a*) a layer of silicon dioxide of, say, 1000Å thickness is first thermally grown on a substrate 2 of single crystal silicon. A layer 3 of resist (FIG. 1(*b*)) is then deposited on the layer 1 and is irradiated by UV through an apertured mask 4. The irradiated resist is developed, and the silicon dioxide layer 3 is then etched to leave small (say 1 micron square) rectangular pads 5 (FIG. 1(*c*)) of silicon dioxide on the substrate 2.

The substrate is then dry etched by exposure to an $SF_6/N_2/O_2$ plasma. This removes regions 6 of the substrate between the pads 5, leaving unetched silicon columns 7 immediately beneath the pads 5. These columns may be of the order of 1–5 microns high.

The columns are then etched using an anisotropic wet chemical etch, with a material such as potassium hydroxide. Due to the presence of the pads 5, the upper end of each column 7 is substantially unaffected, but the column is etched into an inverted pyramid shape 8 (FIG. 1(*e*)). At the same time, the etch removes regions 9 of the substrate between the columns so that pyramids 10 remain beneath the inverted pyramids 8.

A layer 11 of silicon dioxide (FIG. 1(*f*)) which is doped with phosphorus or boron/phosphorus is deposited over the substrate, the pyramids 8 and 10 and the pads 5, followed by a planarising layer 12 of a resist which is spun on to the layer 11. The layer 12 is etched through a mask 34 which covers the regions around the pyramid structures. This leaves silicon dioxide pads 13 (FIG. 1(*g*)) substantially the same height as the combined pyramids 8 and 10.

A layer 14 (FIG. 1(*h*)) of resist is then spun on to the structure, covering the pads 13 and the pyramids 8 and 10. The resist layer is etched back to expose the tops of the pads and the tops of the pyramids 8 (FIG. 1(*i*)). A metal layer 15 of, say, 0.5–1.0 microns thickness is then deposited over the structure, in contact with the pyramids 8 and supported by the pads 13 and the remaining portions of the resist layer 14.

Those portions of the resist layer are then dissolved and the wet etching process is resumed so that the pyramids 8 and 10 become progressively thinner until their tips separate, leaving sharp-pointed lower pyramids 16 supported by the remaining part of the substrate 2, and sharp-pointed upper pyramids 17 supported by the metal layer 15 which, in turn, is supported by the substrate by way of the pads 13.

The cavity in which the tips of the pyramids lie may be evacuated or may be gas-filled to any suitable pressure.

Figure 2:
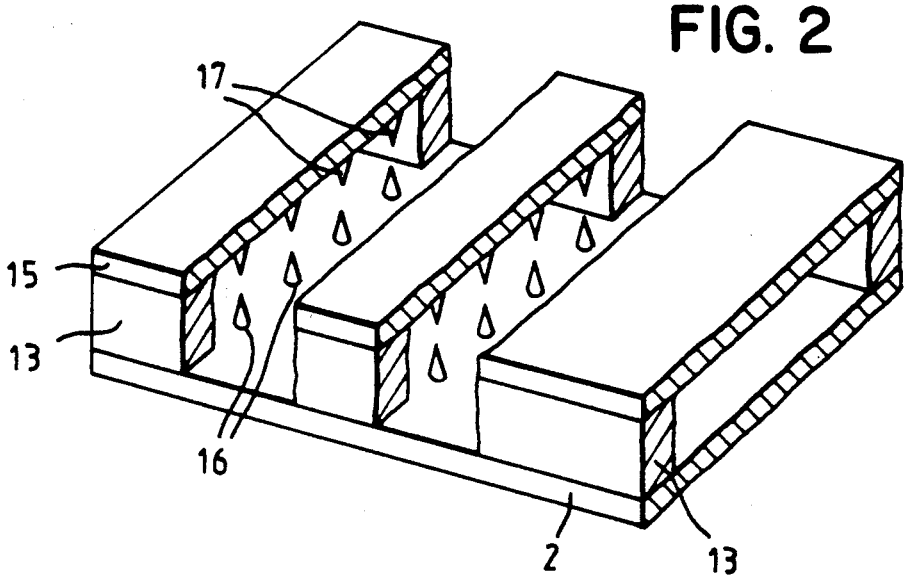
FIG. 2 illustrates, schematically, the formation of a plurality of separate rows of the devices.
Figure 3:
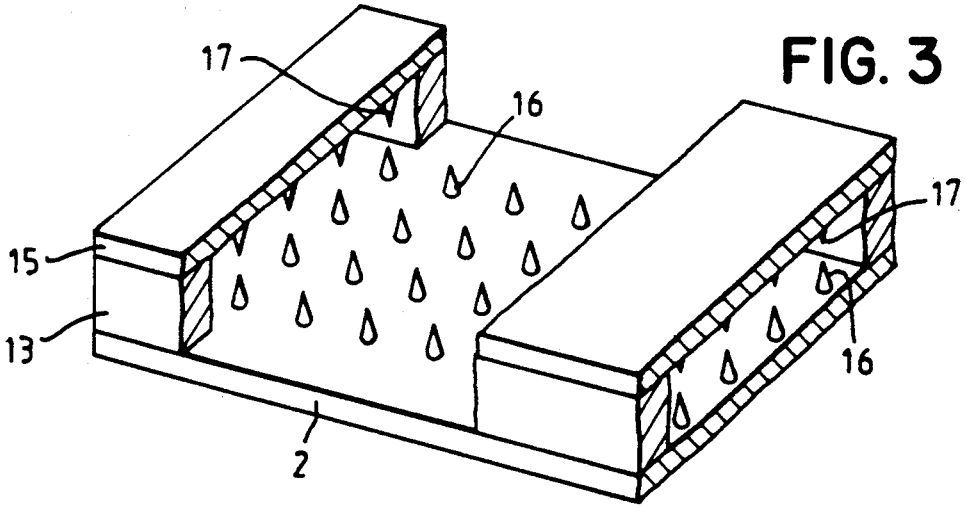
FIG. 3 illustrates, schematically, the formation of a matrix of interconnected devices, FIGS. 4(*a*)–4(*g*) illustrate, schematically, stages in a second method in accordance with the invention for forming field-emission devices.
Figure 4A:
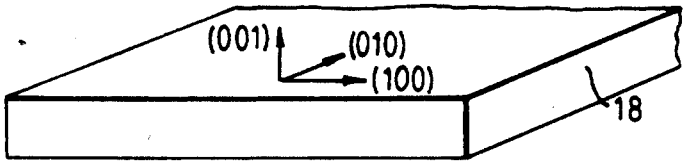
Figure 4B:
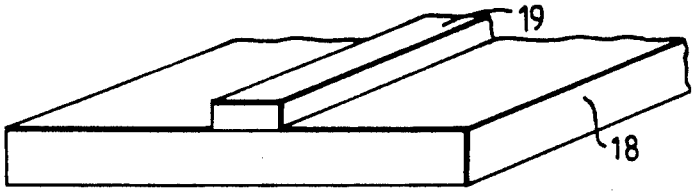
Figure 4C:
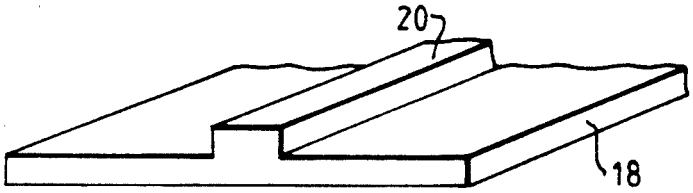
Figure 4D:
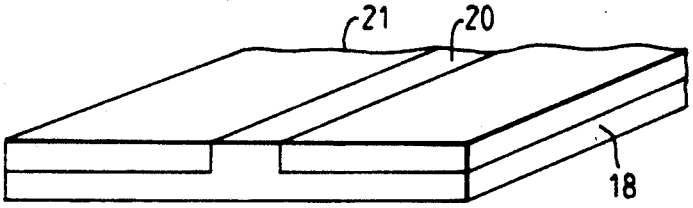
Figure 4E:
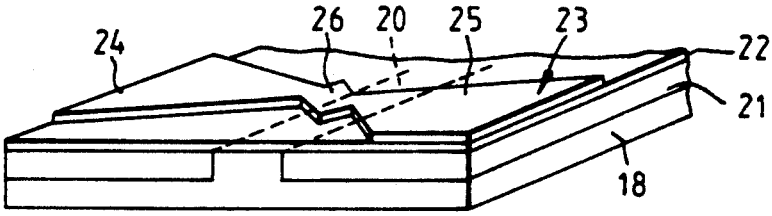
Figure 4F:
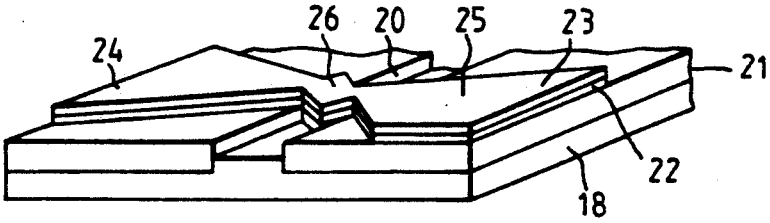
Figure 4G:
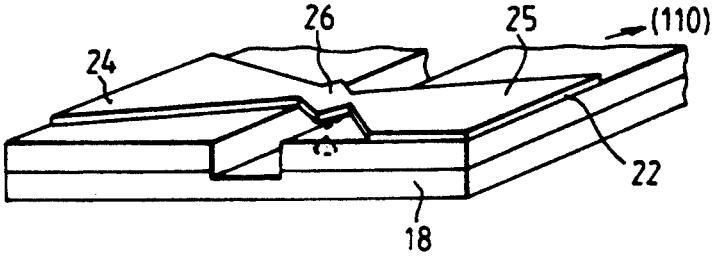

The pyramid structures may be formed in strips such as shown in FIG. 2 or in a matrix array such as shown in FIG. 3.

By making electrical connections to the substrate 2 and the metal layer 15 and applying a suitable voltage therebetween, field emission between the tips can be achieved. The device may be used, for example, as a surge arrestor.

Various modifications of the method would be possible. For example, although in the embodiment described above the substrate 2 is formed of silicon, it could alternatively be a single crystal metal substrate. Furthermore, instead of the final separation of the tips of the pyramids being effected by further wet anisotropic etching, a silicon dioxide region could be grown at the tips and then removed to separate the tips. Alternatively, the formation of the pyramids might be effected by a dry etching process. Instead of the pyramid shapes described above, the tapered structures might be conical or any other tapered shape.

A description of a second method in accordance with the invention will now be provided with reference to FIGS. 4(*a*)–(*g*) of the drawings, which show the construction of a single device by way of example. A single crystal substrate 18 of, for example, silicon or tungsten has plane orientations as shown in FIG. 4(*a*). Such orientations are required for the wet etching step which will be described later. This orientation is likely to be required for most cubic materials, but other materials and other etchants may require different orientations.

A mask 19 (FIG. 4(*b*)) is formed, for example, by thermal oxidation in the case of a silicon substrate or by chemical vapour deposition in the case of a tungsten substrate. The mask is patterned by a photo-lithographic or electron beam lithographic method. The particular mask material is chosen as appropriate for subsequent deep etching of the underlying substrate.

The substrate is etched, leaving a ridge 20 (FIG. 4(*c*)) at the region where the mask 19 was located. The ridge may be up to about 2 microns high and may be about 1 micron wide for a single row of devices.

The oxide layer 21, such as p-doped silicon dioxide, is deposited over the structure and is planarised (FIG. 4(*d*)), either by selective masking and etching or by depositing thereover a sacrificial planarising layer which is then etched using a method whereby its etch rate is matched to that of the oxide layer 21.

A metal layer 22 is deposited over the oxide layer 21. The layer 22 may be of any suitable metal, but in order to allow high-temperature annealing of the completed device a platinum layer may be used together with a buffer layer which may be formed of, for example, chromium or nickel for promoting adhesion of the underlying layers of silicon or other metal or semiconductor material. In the case of a semiconductor layer, a metallization material providing an ohmic contact to the semiconductor would be preferred. The metal layer 22 is then covered with a resist layer 23 (FIG. 4(*e*)) which is shaped to cover contact pad areas 24 and 25 and a square region 26 which is located over the ridge 20. The edges of the region 26 are aligned with the [110] directions in the case of a silicon or tungsten substrate.

Figure 5:
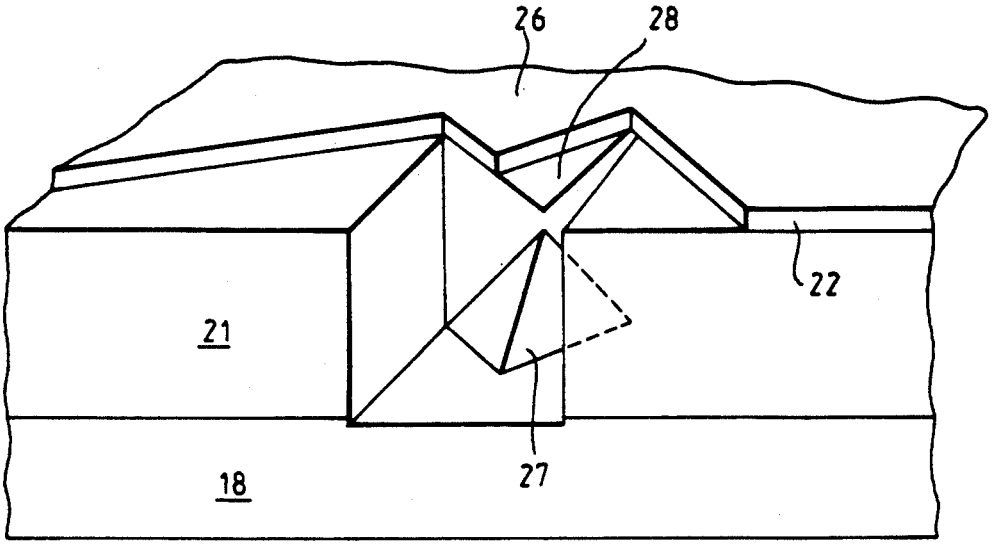
FIG. 5 shows an enlarged section through one of the devices.

The structure is then dry etched to remove the areas of the layer 22 not covered by the resist and the etching is continued down into the ridge 20, to remove, say, half of the height of the ridge. It may also be advisable to etch away redundant areas of the insulating layer 21 at this stage, in order to reduce thermal expansion mismatch problems with the substrate. The structure is then wet etched, the etchant being preferably potassium hydroxide for silicon or tungsten substrates. This wet etching erodes the sides (FIG. 4(*g*)) of that region of the ridge 20 which lies beneath the area 26 of the layer 23, so that the region tapers from each end towards an intermediate point in its height. The etching is continued until the intermediate part is eroded away, leaving two separate pyramids 27 and 28 (seen more clearly in FIG. 5), the pyramid 27 being integral with the remainder of the substrate 18, and the pyramid 28 being inverted and supported by the layer 22.

The progress of the etching can be monitored by making electrical connection to the metal layer 22 and the substrate 18 and monitoring the resistance therebetween. The abrupt change in resistance which occurs when the pyramids separate acts as an end of etch indication. The electrical bias applied by such connections would also enable the etch rate to be controlled. For some materials, such as tungsten, this bias would be required for obtaining an anisotropic etch. The monitoring of resistance would be useful in preventing over-etching of the tips of the pyramids, which prevention is essential if closely-spaced tips (e.g. around 0.1 micron separation) and sharp tip points (e.g. less than 0.1 micron) are to be achieved so that field emission can be obtained at low voltage (e.g. less than 100 volts).

Figure 6:
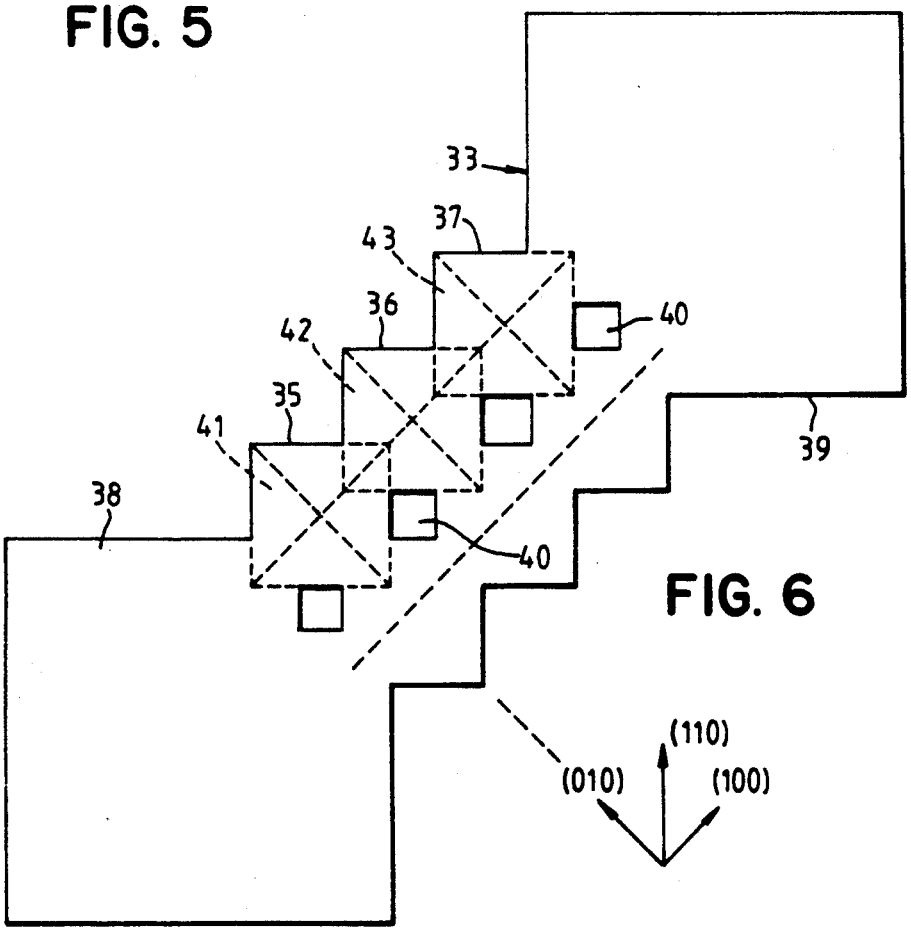
FIG. 6 is a schematic plan view of a portion of a mask for use in forming, a plurality of field-emission devices.

FIG. 6 shows a part of a masking and connection layer 33 for forming a multi-tipped diode device. The layer provides overlapping pads, such as the pads 35, 36 and 37, each corresponding to a region 26 of FIG. 4 (*e*) and contact areas 38 and 39 corresponding to the areas 24 and 28 of that figure. Apertures 40 provide an entry for the etchant. Intersecting pyramids 41, 42 and 43 will be produced beneath the pads 35, 36 and 37, respectively.

We claim:

1. A method of forming an electron emission device, the method comprising the steps of: providing a first layer of electrically-conductive material; forming from said first layer a column-like structure having a first end integral with said first layer and a second end, said structure having a first portion tapering from said first end towards an intermediate region of the structure and a second portion tapering from said second end towards said intermediate region; said second end of said structure being attached to a second electrically-conductive layer spaced from said first layer; and removing part of the structure at said intermediate region to separate said first and second portions from each other, whereby two tapered bodies are provided with their sharp ends substantially aligned and closely spaced, to form respective electrodes of the device.

2. A method as claimed in claim 1, wherein the formation of the column-like structure is effected by first forming a substantially straight-sided pillar from said first layer and subsequently etching the sides of the pillar and the first layer therebeneath to form the tapered structure.

3. A method as claimed in claim 2, wherein the second electrically-conductive layer is formed in contact with said structure after the etching of the sides of the pillar and the first layer has been effected.

4. A method as claimed in claim 2, wherein the second electrically-conductive layer is formed in contact with said first layer before formation of the pillar from said first layer.

5. A method as claimed in claim 2, wherein the column-like structure is formed by subjecting said pillar and said first layer therebeneath to an anisotropic wet etching process.

6. A method as claimed in claim 1, wherein said first layer is formed of single crystal silicon.

7. A method as claimed in claim 1, wherein said first layer is formed of single crystal metal.

8. A method as claimed in claim 7, wherein said metal is tungsten.

9. A method as claimed in claim 1, wherein the step of removing part of the structure at said intermediate portion is monitored by checking for abrupt change in electrical resistance between said first and second layers occurring when said first and second portions separate.

10. A method as claimed in claim 3, further comprising the steps of encircling the structure with a layer of support material; depositing said second electrically-conductive layer on the support material; and thereafter removing the support material

* * * * *